US006138923A

United States Patent [19]

Nakano et al.

[11] Patent Number: 6,138,923

[45] Date of Patent: Oct. 31, 2000

[54] INJECTOR

[75] Inventors: Futoshi Nakano; Tadashi Uchiyama, both of Kanagawa, Japan

[73] Assignee: Isuzu Motors Limited, Tokyo, Japan

[21] Appl. No.: 09/194,024

[22] PCT Filed: Mar. 24, 1998

[86] PCT No.: PCT/JP98/01269

§ 371 Date: Nov. 19, 1998

§ 102(e) Date: Nov. 19, 1998

[87] PCT Pub. No.: WO98/42974

PCT Pub. Date: Oct. 1, 1998

[30] Foreign Application Priority Data

Mar. 25, 1997 [JP] Japan ..... 9-088670
Mar. 27, 1997 [JP] Japan ..... 9-091339

[51] Int. Cl.[7] ..... F02M 47/02

[52] U.S. Cl. ..... 239/88; 239/93; 239/95; 239/96; 239/533.11; 188/322.16; 277/447

[58] Field of Search ..... 239/88, 89, 90, 239/91, 92, 93, 94, 95, 96, 533.11; 188/322.16, 322.17; 277/435, 447

[56] References Cited

U.S. PATENT DOCUMENTS

| | | | |
|---|---|---|---|
| 2,967,745 | 1/1961 | Stevens | 277/346 |
| 3,939,872 | 2/1976 | Wentworth, Jr. | 239/89 X |
| 4,381,077 | 4/1983 | Tsumura et al. | 239/89 |
| 5,423,484 | 6/1995 | Zuo | 239/95 X |
| 5,652,381 | 7/1997 | Fuchs | 73/118.1 |
| 5,743,234 | 4/1998 | Nemoto et al. | 123/446 |
| 5,992,768 | 11/1999 | Beatty . | |

FOREIGN PATENT DOCUMENTS

| | | |
|---|---|---|
| 0 809 015 | 11/1997 | European Pat. Off. . |
| 3-047458 | 5/1991 | Japan . |
| 6-087660 | 12/1994 | Japan . |
| 6-511527 | 12/1994 | Japan . |
| 8-042425 | 2/1996 | Japan . |
| 9-217663 | 8/1997 | Japan . |
| 93-07380 | 4/1993 | WIPO . |

*Primary Examiner*—Lesley D. Morris
*Assistant Examiner*—Robin O. Evans
*Attorney, Agent, or Firm*—Browdy and Neimark

[57] ABSTRACT

An injector of intensified fuel injection type is disclosed in which a resin-made sealing member for sealing a clearance between a concave and a boosting piston fitted in the concave for reciprocating movement is protected from deterioration owing to high-pressure impulses occurring in the hydraulically actuating fluid in pressure chamber or in the fuel in the intensified chamber. The sealing member of resin-made O ring 44 prevents leakage of the hydraulically actuating fluid from the pressure chamber 8 to the spring chamber 30 through the clearance 27 between the enlarged concave and the boosting piston 119. A split metal ring 91 is arranged between the relatively sliding surfaces 49*a*, 49*b* of the enlarged concave 26 and the boosting piston 119 at any location between the pressure chamber 8 and the O ring 44. The split ring 91 may predominantly support the dynamic high-pressure impulses occurring in the pressure chamber to thereby isolate the O ring 44 from the impulses, resulting in preventing the O ring 44 from deterioration.

10 Claims, 9 Drawing Sheets

INJECTOR

TECHNICAL FIELD

The present invention relates to an injector in which a boosting piston may intensify fuel supplied in an intensified chamber through a common fuel supply rail.

BACKGROUND ART

The conventional hydraulically-actuated, electronically-controlled fuel injection apparatus is disclosed in, for example, Published Japanese translations of PCT international publication No. 511527/1994. The injector used in the prior fuel injection apparatus has the structure, for example, shown in FIG. 13, which may control in a variable manner the fuel flow characteristics of the hydraulically-actuated injector in the fuel injection stroke of the engine and make possible the quick starting of the engine.

Referring to FIG. 13, the prior injector 1 has comprised of a main body having a central passage and fuel injection holes 13, and a casing 6 arranged so as to form an annular clearance for a fuel chamber 20 around the main body. The main body of the injector 1 comprises a nozzle body 2 formed with a central passage 49 and injection holes 13, a fuel supply body, or plunger barrel 5 forming an intensified chamber 7, a spacer body 81 and an annular spacer body 21 arranged between the nozzle body 2 and fuel supply body 5, the annular spacer body being provided therein with a bore 29, an injector body 4 provided with a pressure chamber 8 supplied with hydraulically actuating fluid, and a solenoid body 3 having therein a solenoid valve 16, the solenoid body being provided with a leak line of a draining groove 39 and a draining passage 38. The casing 6 surrounds all of the nozzle body 2, spacer body 81, annular spacer body 21 and fuel supply body 5 so as to provide the fuel chamber 20 between them and itself, the casing 6 being further secured to the injector body 4 to thereby keep the bodies in integration. The casing 6 is engaged in a fluid-tight manner at its one end with a stepped abutment 14 of the nozzle body 2 and also sealed at its other end against the injector body 4 by screw-fitting at a threaded face 80 thereof. The casing 6 has fuel inlet 11 and fuel outlet 12, both of which open to a common fluid supply rail 51 from which the fuel is constantly applied to the fuel chamber 20.

The injector 1 comprises an intensified chamber 7 provided in the fuel supply body 5 for intensifying the fuel fed from the fuel chamber 20, a fuel pass 22 formed through the spacer body 81, annular spacer body 21 and nozzle body 2 to supply the fuel from the intensified chamber 7 to the injection holes 13. The injection 1 further includes a needle valve 23 held for sliding movement in the central passage 46 in the nozzle body 2 so as to open the injection holes 13 by the action of the fuel pressure, a boosting piston 109 for applying pressure to the fuel in the intensified chamber 7, the pressure chamber 8 being supplied with hydraulically actuated fluid for applying the high pressure to the axial end of the boosting piston 109, and the solenoid actuated control valve 16 controlling the supply of the hydraulically actuated fluid into the pressure chamber 8.

Arranged in the bore 29 in the annular spacer body 29 is a return spring 18 to forcibly urge the needle valve 23 towards a closed position where the injection holes 13 are closed. The return spring 18 is abutted at its one end against the top of the needle valve 23 and at its the other end against the spacer body 81. The injector body 4 is provided therein with a concave 26 larger in diameter for forming a spring chamber 30 defined between opposing end faces of the fuel supply body 5 and an enlarged diameter portion 115 of a boosting piston 109. The spring chamber 30 contains therein a return spring 17 to forcibly urge the boosting piston 109 towards the pressure chamber 8. Arranged in a hollow 85 in the injector body 4 is a return spring 19 to normally bias the solenoid valve 16 towards a position where the flow of the hydraulically actuating fluid is shut off. The spring chamber 30 having the boosting piston 109 therein communicates with the fuel chamber 20 through a passageway 83 having a non-return valve 84 therein. Although the spring chamber 30 normally allows the entry of leakage fuel under the pressure equal with that in the fuel chamber 20, reciprocating movement of the boosting piston 109 forcibly displaces inflow fuel from the spring chamber 30 with the formation of a space.

The boosting piston 109 comprises a radially-reduced portion 114 forming a plunger having the bottom face to define partially the intensified chamber 7, and the radially-enlarged portion 115 arranged for reciprocating movement in the concave 26 in the injector body 4 and provided with the top face to define partially the pressure chamber 8. The boosting piston further includes a guide ring portion 118 depending from the periphery of the enlarged portion 115 so as to form a sliding surface 49 for linear movement in contact with the inner surface of the concave 26. The ring portion 118 is to ensure the steady reciprocating movement of the boosting piston 109. While the reduced portion 114 of the boosting piston 109 is arranged in a radially-reduced bore 42 for reciprocating movement, the enlarged potion 115 is arranged in the concave 26 in the fuel supply body 5. Provided in the concave 26 in the injector body 4 is a sealing member 44 of a rubber-made O ring for sealing up a clearance between the boosting piston 109 and the concave 26 to prevent leakage of the hydraulically-actuating fluid in the pressure chamber 8 into the spring chamber 30, resulting in blockage between the spring chamber 30 and pressure chamber 8. The return spring 17 is arranged between the fuel supply body 5 and the boosting piston 109 in compression. The reduced portion 114 and the enlarged portion 115 are formed separately from each other and the top face 116 of the reduced portion 114 is abutted against the enlarged portion 115 at its inner surface.

The intensified chamber 7 is defined at an end of the radially-reduced bore 42 in the fuel supply body 5 and supplied with the fuel from the fuel chamber 20 through a fuel passageway 37 in the annular spacer body 21 and a fuel passageway 35 in the spacer body 81. The fuel passageway 35 provided with a non-return valve 36 for checking a backward flow of pressurized fuel in the intensified chamber 7 to the fuel chamber 20. Fuel under pressure in the intensified chamber 7 is supplied to the injection holes 13 through the fuel passes 22 in the spacer body 81, annular spacer body 21 and nozzle body 2. High hydraulic pressure in fuel acts on tapered faces 45 and 45*a* on the needle valve 23 to hydraulically lift the needle valve 23 that is held in the central passage 46 in the nozzle body 2 for linear sliding movement. As a result, the fuel pressure makes a fuel flow between the nozzle body 2 and the needle valve 23 and opens up the nozzle holes 13.

The boosting piston 109 is provided with an annular stepped face 73 that is contoured in exposure to the pressure chamber 8 by planing down the periphery of the top surface 75 of the enlarged portion 115. A surface of the injector body 4 exposed to the pressure chamber 8 is formed in a flat face 72 which is in parallel with the top surface 75 of the boosting piston 109. It will be noted that an annular narrowed clearance 74 for the pressure chamber 8 may be provided between the opposed faces 72 and 73 of the injector body 4 and the boosting piston 109. The boosting piston 109 is forcibly abutted at its central rise against the flat face 72 of the injector body 4 by the action of the return spring 17.

In this prior injector 1, the spring chamber 30 having the return spring therein is defined in the radially-enlarged concave 26 that is formed in the injector body 4 for the linear sliding movement of the enlarged portion 115 and guide ring portion 118 of the boosting piston 109. The sealing member 44 interposed between the enlarged portion 115 and the concave 26 is to seal up the peripheral sliding surface 49 of the boosting piston 109, which may is in sliding contact with the concave 26, resulting in prevention of fuel leakage from the spring chamber 30 into the pressure chamber 8. The fuel in the boosting chamber 7 is allowed to invade the spring chamber 30 through a small clearance around the reduced portion 114 for a plunger, or the sliding surface 43 of the reduced portion 114 in contact with the radially-reduced bore 42 of the fuel supply body 5. The fuel in the fuel chamber 20 is also allowed to invade the spring chamber 30 through a clearance between the opposed surfaces of the injector body 4 and the fuel supply body 5, which are abutted against each other. It is to be noted that the spring chamber 30 is normally provided with a cavity equivalent with a stroke of the boosting piston 109. On the fuel in the spring chamber 30 increasing to the level where the cavity in the spring chamber 30 is reduced in volume less than the stroke of the boosting piston 109, the fuel in the spring chamber 30 is discharged to the fuel chamber 20 through passageway 83 having the non-return valve 84.

The return spring 17 is arranged between a spring retainer 117 and the top face of the fuel supply body 5 in compression so as to make the reduced portion 114 follow the movement of the enlarged potion 115. The top 116 of the reduced portion 114 abutted against the enlarged portion 115 is designed in the form of a convex.

Disclosed in FIG. 12 is a prior engine fueling system for an internal combustion engine having incorporated with the injector 1. The engine fueling system includes the injectors 1 each assigned to a cylinder and connected to a common fuel supply rail 51, which is supplied with fuel from a fuel tank 52 through a fuel filter 54 by the driving of fuel pump 53. The common fuel supply rail 51 communicated with the injectors 1 is connected to the fuel tank 52 through a fuel recovery line 55. It will be understood that the injectors 1 is constantly supplied with the fuel of the required pressure at the fuel inlets 11 and fuel outlets 12 through the common fuel supply rail 51.

The injector 1 is designed so as to feed hydraulically actuating fluid, or high-pressurized oil, to the intensified chamber 8 for applying the boosting pressure to the fuel. The injectors 1 are communicated to a high-pressure fluid manifold 56, to which the fluid in a fluid reservoir 57 is fed through a fluid supply line 61 by the driving of a fluid pump 58. There are provided a fluid cooler 59 and a fluid filter 60 in the fluid supply line 61. The fluid supply line 61 is branched into a lubricant line 67 communicating with an oil gallery and a hydraulic fluid line 66 communicated with a hydraulic pump 63. A flow control valve 64 is to regulate the fluid supply to the high-pressure fluid manifold 56 from the hydraulic pump 63 through the hydraulic fluid line 66. A controller unit 50 is designed so as to control both of the flow control valve 64 and solenoids 10. The controller unit 50 is applied with data indicative of the performance of an engine, that is, rotational frequencies detected by a rotational frequency sensor 68, throttle valve openings detected by a accelerometer 69 and crankshaft angles detected by a crank angle sensor 70 crank travel crankshaft revolutions valve openings. The controller unit 50 is also input with a hydraulic pressure at a pressure sensor 71 in the high-pressure fluid manifold 56.

The solenoid 10 is to actuate needle valves 23 for opening and closing the nozzle holes 13. Now referring to FIG. 3, energizing the solenoid 10 under favor of an instruction from the controller unit 50 attracts an armature 32, causing lifting the solenoid valve 16 against the return spring 19. Lifting the solenoid valve 16 results in separation of a tapered surface 86 of the solenoid valve 16 from a valve seat 87 of the injector body 4 to thereby make an annular clearance 33 for admitting the hydraulic-actuating fluid into the pressure chamber 8 from the high-pressure fluid manifold 56 through a fluid inlet port 31 and fluid passageway 34 in the injector body 4. The hydraulically actuating fluid applied into the pressure chamber 8 fills up the annular clearance 74 defined between the top surface 75 of the enlarged portion 115 of the boosting piston 109 and the flat face 72 of the injector body 4 to thereby act on the boosting piston 109. Meanwhile, the fuel in the common fuel supply rail 51 is fed into the fuel chamber 20 through the fuel inlet 11 in the casing 6, and then supplied into the intensified chamber 7 from the fuel chamber 20 through both of the fuel passageway 37 in the annular spacer body 21 and the fuel passageway 35 in the spacer body 81.

With the boosting piston 109 moving downwards under the action of the hydraulically actuating fluid, the non-return valve 36 shuts off the fuel passageway 35 to hydraulically intensifying the fuel in the intensified chamber 7. As a result, the hydraulic pressure in the fuel acts on the tapered faces 45, 45*a* on the needle valve 23 to cause the lifting of the needle valve 23 against the return spring 18. Electromagnetically de-energizing the solenoid 10 causes downward movement of the solenoid valve 16 by the action of the return spring 19 to thereby open the draining grove 39 for discharging the hydraulically actuating fluid out of the pressure chamber 8 through the draining grove 39 and the draining passage 38. Following such discharge of the hydraulically actuating fluid out of the pressure chamber 8, the boosting piston 109 may return to its home position under favor of the return spring 17 to make the intensified chamber 7 substantially equal in pressure with the fuel chamber 20. Reduction in the fuel pressure on the needle valve 23 causes seating the tapered face 45 in contact with the valve seat of the nozzle body 2 by the action of the return spring 18 to thereby close the nozzle holes 13.

The prior injector 1 of the type described above has the disadvantage such that, since work to be done on intensifying the fuel by the boosting piston 109 is partially consumed in work done on opening the non-return valve 84 for exhausting the fuel, the fuel injected 1 may lack in amount, or the output may become sufficient, resulting in adverse variations in the amount of injected fuel for each injection cycle or each cylinder, that is, in the rotation of the output shaft in the engine.

Instead of the passageway 83 and the non-return valve 84 employed in the prior injector 1 shown in FIG. 13, this applicant has already filed the co-pending application, refer to Japanese Patent Application No. 46830/1996, to propose an injector 90. Referring to FIG. 14, the injector 90 has a sealing member 47 of rubber-made O ring provided in contact with the sliding surface 43, and a relief port 40 for opening the concave 26 to the atmosphere. According to the proposed injector, there is no invasion of fuel into the concave 26 with the result of no requirement of discharging the fuel invaded. It has become capable of no loss in work done on intensifying by the boosting piston 109 with full efficiency of the intensifying power. In comparison with the injector 1, the injector 90 shown in FIG. 14 is of the s ame construction as the injector 1 with the exception of the provision of the sealing member for preventing leakage of fluid into the concave 26, instead of the discharging of fluid invaded into the concave 26. In the following description, the same reference character identifies equivalent or same parts and the repetition of the same parts is omitted.

In accordance with the injector having the boosting piston 109 described above, the hydraulically actuating fluid in the pressure chamber 8 acts on the boosting piston 109 that intensifies in the intensified chamber 7 the hydraulic pressure with a magnifying in proportion to the surface ratio of the enlarged portion 115 with the reduced portion 114 to thereby forcibly inject the fuel out of the nozzle holes 13 at the tip of the injector. The injectors shown in FIGS. 13 and 14 are identical in that the sealing member of resin-made O ring may separate the intensified chamber from the pressure chamber for preventing the hydraulically actuating fluid and the fuel from contamination with each other. In the injector 1 in FIG. 13, the sealing member 44 of rubber-made O ring is arranged between the concave 26 and the sliding surface 49 of the enlarged portion including the guide ring portion 118 and the leaked fuel in the spring chamber 30 is expelled to the fuel chamber 20 through the passage 83. On the other hand, the injector 90 in FIG. 14 has the sealing member 47 of rubber-made O ring arranged between the relatively sliding surfaces 43 of the radially reduced bore 42 and the reduced portion 114 of the boosting piston 109, and the relief port 40 for opening the spring chamber 30 to the atmosphere in the engine cover.

However, the boosting piston 109 makes the reciprocating movement with high speed for each of injection cycles and thus the sealing members 44, 47 are apt to be subject to deterioration due to abrasion. The applicant has found that even the improved injector proposed by this applicant and shown in FIG. 14 involves the following shortcomings to be eliminated. The extremely high pressure in the intensified chamber 7 may act in the form of impulse waves on the sealing member 47 which is arranged between the relative sliding surfaces 43 of the radially reduced bore 42 and the reduced portion 114 of the boosting piston 109. Such impulse force causes cavitation in the vicinity of the sealing member 47 so that the sealing member 47 of rubber-made O ring get rough at its surface, resulting in adverse reduction in the sealing performance. Deterioration of the sealing member 47 in sealing performance may permit the invasion of fuel from the intensified chamber 7 along the relative sliding surface 43 into concave 26, or the spring chamber 30, from which the fuel is expelled into the cylinder head cover through the relief port 40. There is thus such fear that the contamination of lubricating oil with fuel makes adverse operating conditions of engines such as decrease in viscosity of lubricating oil, insufficient lubrication in engine, destruction of engine parts due to overheating or the like. Contamination of fuel with lubricating oil vice versa causes a danger of making worse the exhaust gases, or increasing the smoke.

An object of the present invention is to overcome the above-described shortcomings to be solved, and to provide an injector in which the leakage of an intensified fuel along relatively sliding surfaces of a concave and a radially enlarged portion or a radially reduced portion of a boosting piston is prevented by sealing members that is provided between the relatively sliding surfaces, the improved injector wherein the sealing members are protected from the action of instantaneous, high-pressure impulses or dynamic high-pressure impulses, applied from a pressure chamber or intensified chamber, by means of blocking the high-pressure impulses on the sliding surfaces at a location between the sealing members and the pressure chamber or intensified chamber, or by means of releasing the high-pressure impulses from the sliding surfaces between the intensified chamber and the sealing members to a lower-pressure side of fuel.

DISCLOSURE OF INVENTION

The present invention is concerned with an injector comprising an intensified chamber formed in an injector body and supplied with a fuel from a common fuel supply rail, a boosting piston for intensifying the fuel in the intensified chamber, the boosting piston being actuated by a hydraulically actuating fluid supplied into a pressure chamber in the injector body, a needle valve arranged in the body so as to open and close nozzle holes to inject the fuel from the intensified chamber, a control valve for controlling the supply of the hydraulically actuating fluid into the pressure chamber to actuate the boosting piston, a return spring for forcing the boosting piston towards its home position, and a casing arranged around the periphery of the injector body to form a fuel chamber and provided with a fuel inlet and a fuel outlet, both of which are communicated with common fluid supply rail, wherein the boosting piston includes a radially enlarged portion forming a part of a surface defining the pressure chamber, and a radially reduced portion forming a part of a surface defining the intensified chamber, both of which portions are fitted for linear sliding movement in a concave in the injector body, a sealing member is provided between relatively sliding surfaces of the radially enlarged portion of the boosting piston and the concave, and a sealing ring is provided between the relatively sliding surfaces at any location determined between the sealing members and the pressure chamber.

The injector of this invention is of the type in which a sealing member is provided between the relatively sliding surfaces of the concave and the enlarged portion of the boosting piston. High-pressure impulses occurring in hydraulically actuating fluid in the pressure chamber upon operation of the control valve may be blocked by the sealing ring which is provided between the relatively sliding surfaces at a location determined between the sealing member and the pressure chamber. The sealing member is, accordingly, subject to no dynamic high-pressure impulses which occur in the hydraulically actuating fluid, resulting in the protection from the deterioration in sealing performance.

The present invention further relates to an injector comprising an intensified chamber formed in an injector body and supplied with a fuel from a common fuel supply rail, a boosting piston for intensifying the fuel in the intensified chamber, the boosting piston being actuated by a hydraulically actuating fluid supplied into a pressure chamber in the injector body, a needle valve arranged in the body so as to open and close nozzle holes to inject the fuel from the intensified chamber, a control valve for controlling the supply of the hydraulically actuating fluid into the pressure chamber to actuate the boosting piston, a return spring for forcing the boosting piston towards its home position, and a casing arranged around the periphery of the injector body to form a fuel chamber and provided with a fuel inlet and a fuel outlet, both of which are communicated with common fluid supply rail, wherein the boosting piston includes a radially enlarged portion fitted for linear sliding movement in a radially enlarged concave in the injector body and forming a part of a surface defining the pressure camber, and a radially reduced portion fitted for linear sliding movement in a radially reduced concave in the injector body and forming a part of a surface defining the intensified chamber, a sealing member is provided between relatively sliding surfaces of the radially reduced portion of the boosting piston and the concave, and a sealing ring is provided between the relatively sliding surfaces at any location determined between the sealing member and the intensified chamber.

The injector of this invention is of the type in which the sealing member is provided between the relatively sliding surfaces of the reduced concave and the reduced portion of the boosting piston. High-pressure impulses occurring in fuel in the chamber intensified hydraulically by the boosting piston may be blocked by the sealing ring which are provided between the relatively sliding surfaces at a location determined between the sealing member and the intensified chamber. The sealing member is, accordingly, subject to no dynamic high-pressure impulses which occur in the fuel in the intensified chamber, resulting in the protection from the deterioration in sealing performance.

In the injector according to the present invention, the sealing member is of a resin-made O ring, while the sealing ring is of a split metal ring having resiliency in diametral (or diametrical) direction thereof. Whereas the resin-made O ring is easy to be damaged owing to the high-pressure impulses occurring in fuel or hydraulically actuating fluid or the cavitation occurring in the vicinity of the resin-made O ring, the split metal ring is resistant against the high-pressure or cavitation and thus hard to be damaged. It is to be noted that the split metal ring alone can not prevent the leakage of the hydraulically actuating fluid and the resin-made O ring should be required to bear the static pressure, resulting in prevention of the leakage of the hydraulically actuating fluid. The split metal ring helps relax the dynamic high-pressure impulses in the hydraulically actuating fluid, resulting in decreasing the influence of the high-pressure or cavitation on the O ring. In case the high pressure in the fuel or hydraulically actuating fluid propagates around the periphery of the split metal ring towards the O ring, the split metal ring having the diametral resiliency may diametrically deflects due to the high pressure so as to close the propagation path of the pressure whereby the O ring may be protected from the action of the high pressure.

The split metal ring for the injector of the present invention is accommodated under the radial compression stress in an annular recess, which is formed on the enlarged portion or the reduced portion of the boosting piston. The split metal ring has the diametrally-expanding resiliency. Where the high pressure in the fuel or hydraulically actuating fluid propagates around the periphery of the split metal ring towards the O ring, the split metal ring may deflect in its diametral expansion due to the high pressure so as to close the propagation path of the pressure whereby the O ring may be protected from the action of the high pressure.

The injection of the present invention has the boosting piston, which has communicating passages on its enlarged portion or its reduced portion for communicating the annular recess with the pressure chamber or the intensified chamber. The high pressure occurring in the hydraulically actuating fluid in the pressure chamber or the fuel in the intensified chamber may act on not only the sealing members through the mechanical clearances between the relatively sliding surfaces of the concave and the enlarged portion or the reduced portion of the boosting piston, but also the inner periphery of the split metal ring, which is fitted in the annular recess, through the communicating passages formed on the enlarged portion or the reduced portion of the boosting piston. As the split metal ring having the diametrally-expanding resiliency is subjected to the high pressure in the fuel or hydraulically actuating fluid through the communicating passages, the split metal ring may deflect in its diametral expansion due to the high pressure so as to shut out the propagation path of the pressure along the mechanical clearances between the relatively sliding surfaces, whereby the O ring may be protected from the action of the high pressure.

The present invention is further, concerned with a injector comprising an intensified chamber formed in an injector body and supplied with a fuel from a common fuel supply rail, a boosting piston for intensifying the fuel in the intensified chamber, the boosting piston being actuated by a hydraulically actuating fluid supplied into a pressure chamber in the injector body, a needle valve arranged in the body so as to open and close nozzle holes to inject the fuel from the intensified chamber, a control valve for controlling the supply of the hydraulically actuating fluid into the pressure chamber to actuate the boosting piston, a return spring for forcing the boosting piston towards its home position, and a casing arranged around the periphery of the injector body to form a fuel chamber and provided with a fuel inlet and a fuel outlet, both of which are communicated with common fluid supply rail, wherein the boosting piston includes a radially enlarged portion forming a part of a surface defining the pressure chamber, and a radially reduced portion forming a part of a surface defining the intensified chamber, both of which portions are fitted for linear sliding movement in a concave in the injector body, sealing members are provided between relatively sliding surfaces of the radially reduced portion of the boosting piston and the concave, and the relatively sliding surfaces are communicated with the common fuel supply rail or the fuel chamber through communicating passages at a location determined between the sealing members and the intensified chamber.

According to the injector of the present invention as explained just above, since the sealing members are provided between the relatively sliding surfaces of the concave and the reduced portion of the boosting piston and also the relatively sliding surfaces are communicated with the common fuel supply rail or the fuel chamber through communicating passages at a location determined between the sealing members and the intensified chamber, the high pressure of impulse wave may be released to the lower-pressure fuel line such as the common fuel supply rail or the like, before reaching the sealing members through the relatively sliding surfaces, whereby the O ring may be protected from the action of the high pressure and prolonged in sealing life.

In the injector of the present invention, furthermore, the high pressure of impulse wave from the intensified chamber may be attenuated owing to the annular recess open to the communicating passage, which recess is formed on any one of the relatively sliding surfaces of the concave or the reduced portion of the boosting piston.

BEST MODE FOR CARRYING OUT THE INVENTION

Figure 1:
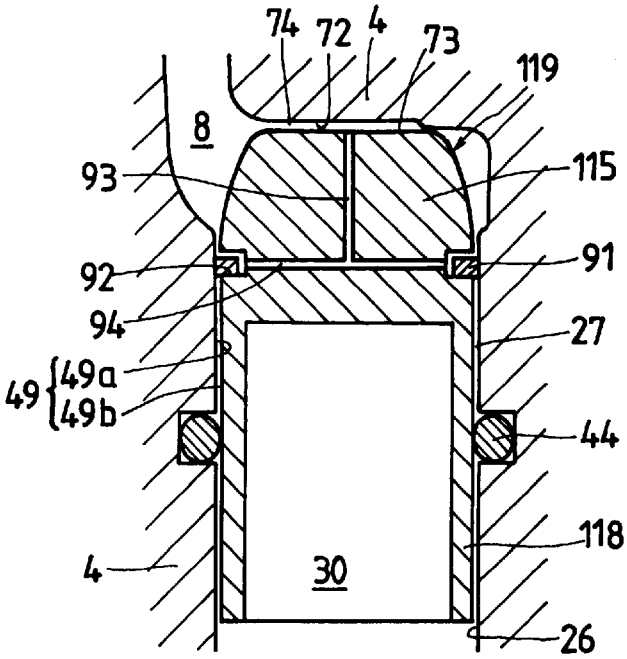
FIG. 1 is a fragmentary axial-sectional view showing the essential parts of a first embodiment of an injector according to the present invention.
Figure 13:
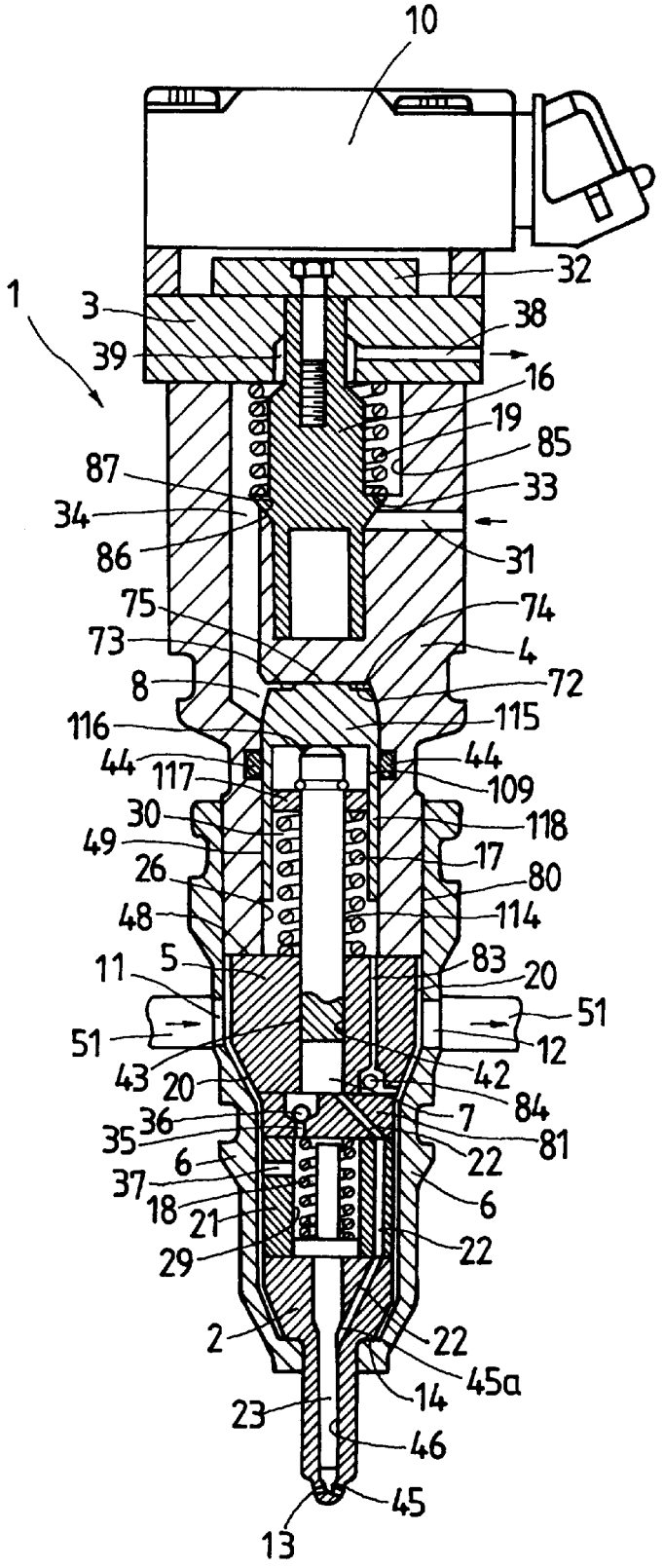
FIG. 13 (PRIOR ART)
FIG. 13 is an axial-sectional view showing a prior injector.

Referring now in detail to the drawings, the preferred embodiments of the injector according to the present invention will be explained below. FIG. 1 is a fragmentary axial-sectional view showing the essential parts, that is, a radially enlarged portion of a boosting piston and a constitution around the piston, of a first embodiment of an injector according to the present invention. It is to be noted that the residual constitution other than parts shown in FIG. 1 is identical with that of the injector in FIG. 13 and therefore the repetition of the same description will be omitted. In the following description, the same reference character identifies equivalent or same parts in both of FIGS. 1 and 13 and the repetition of the same parts and the principal fuel injection operation thereof will be omitted.

Referring to FIG. 1, in which there is the radially enlarged portion 115 and the guide ring portion 118 of the boosting piston 119, with a radially reduced portion being left out. On mechanical designing, it is very hard to eliminate a small mechanical clearance 27 between a sliding surface 49*a* of the radially enlarged concave 26 and a sliding surface 49*b* of the boosting piston 119, which is arranged for reciprocating movement in the enlarged concave 26. As a result, the hydraulically actuating fluid in the pressure chamber 8 is apt to leak in the spring chamber 30 through the clearance 27. The leakage of the hydraulically actuating fluid may be prevented by means of the sealing member 44 of an O ring, which is provided between the relatively sliding surfaces 49*a* and 49*b*. It is to be noted that the O ring 44 is made of resins, in general, rubber that is easy to be damaged owing to not only the high pressure impulses in the fuel or the hydraulically actuating fluid, but also the cavitation occurring in the vicinity thereof.

For the protection of the O ring 44 from the direct effect of the high pressure impulses in the pressure chamber 8, there is provided a metallic ring 91 having the figure of character "C" just like the piston ring, hereinafter referred to as "split ring", which is arranged between the relatively sliding surfaces 49*a*, 49*b* at any location between the pressure chamber 8 and the O ring 44. Preferably, the split metal ring 91 is arranged somewhere near the pressure chamber 8 with respect to the O ring 44 between the relatively siding surfaces 49*a* and 49*b*. According to the embodiment shown, the split ring 91 is fitted under the diametral compression in an annular recess 92 around the enlarged portion 115 of the boosting piston 119. As an alternative, the annular recess for the split ring may be formed on the enlarged concave 26. The actuation of the control valve, or the solenoid valve 16, causes the high-pressure impulses in the hydraulically actuating fluid in the pressure chamber 8. Such dynamic, high-pressure impulses in the hydraulically actuating fluid is firstly supported by the split ring 91 fitted in the annular recess 92, so that the O ring 44 is only exposed to a static, substantially constant pressure. It will be thus understood that both of the O ring and the split ring may bear, respectively, their shares of the hydraulic pressure with the result of prolonging their sealing performances.

The split ring 91 is made of metal which may withstand against the high pressure and cavitation and is hard to be damaged. The split metal ring 91 may relax the high pressure impulses in the hydraulically actuating fluid propagating along the clearance 27 from the pressure chamber 8, with the result that the cavitation has little influence on the O ring 44. The split ring 91 is partially cut away in the form of the character "C", which has the diametral resiliency so as to be deflective diametrally with a small stress. Accordingly, upon the high pressure impulses in the hydraulically actuating fluid or fuel propagating around the split ring 91 towards the O ring 44, the split ring 91 makes deflection diametrally to block the propagation path, causing the relaxation of the high pressure acting on the O ring.

The split ring 91 fitted in the annular recess 92 around the enlarged portion 115 has the resiliency of diametrally expansion and thus deflects in the diametrically-expanding direction owing to the high pressure impulses in the hydraulically actuating fluid or fuel, which propagate around the split ring 91 towards the O ring 44. The diametrally-expanded split ring 91 makes abutment against the sliding surface 49*a* of the enlarged concave 26 to block the propagation path for the pressure, resulting in relaxation of the high pressure impulses.

In the injector of the present invention, the boosting piston 119 is provided at its enlarged portion 115 with communicating passages 93, 94 for making a fluid connection between the pressure chamber 8 and the annular recess 92 to thereby render the split ring 91 more easy deflective. The high pressure occurring in the hydraulically actuating fluid or fuel in the pressure chamber 8 reaches the annular recess 92 on the boosting piston 119 through the communicating passages 93, 94 formed in the enlarged portion 115 of the boosting piston and finally acts on an inner face of the split ring 91. The split ring 91 of diametrally expansion may easily deflect radially outwardly of the ring owing to the high pressure in the hydraulically actuating fluid or fuel.

Figure 2:
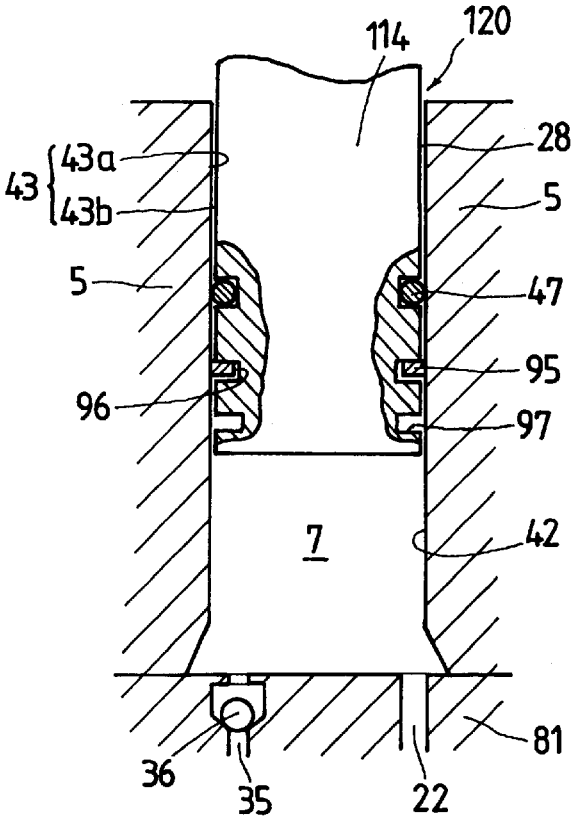
FIG. 2 is a fragmentary axial-sectional view showing the essential parts of a second embodiment of an injector according to the present invention.
Figure 14:
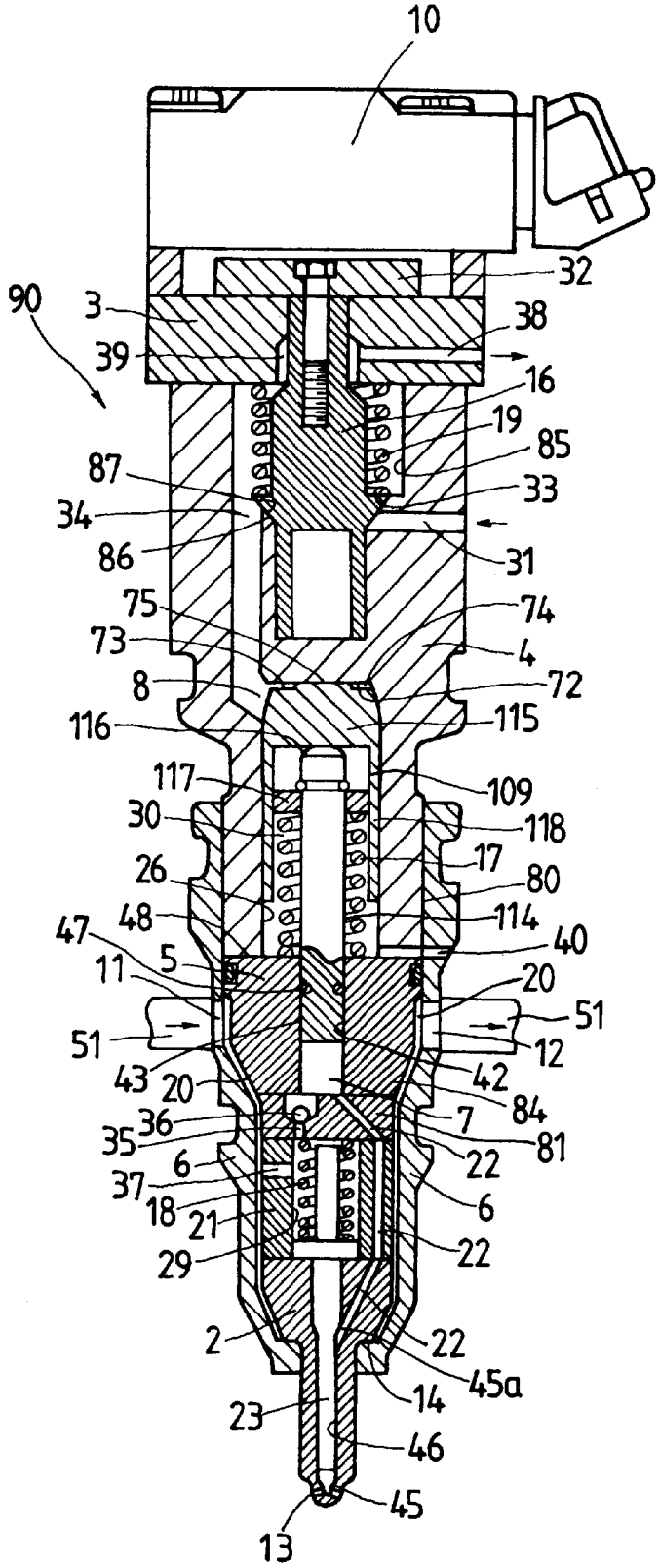
FIG. 14 is an axial-sectional view showing an injector disclosed in co-pending application by this applicant.

FIG. 2 is a fragmentary axial-sectional view showing the essential parts, that is, a radially reduced potion of a boosting piston and a constitution around the piston, of a second embodiment of an injector according to the present invention. It is to be noted that the residual constitution other than parts shown in FIG. 2 is identical with that of the injector in FIG. 14 and therefore the repetition of the same description will be omitted. In the following description, the same reference character identifies equivalent or same parts in both of FIGS. 2 and 14 and the repetition of the same parts and the principal fuel injection operation thereof will be omitted.

Referring to FIG. 2, in which there is only the radially reduced portion 114 of the boosting piston 120, with a radially enlarged portion being left out. On mechanical designing, it is very hard to eliminate a small mechanical clearance 28 between a sliding surface 43*a* of the radially reduced concave 42 and a sliding surface 43*b* of the radially reduced portion 114 of the boosting piston 120, which is arranged for reciprocating movement in the reduced concave 42. As a result, the fuel in the intensified chamber 7 is apt to leak in the spring chamber 30 through the clearance 28. The leakage of the fuel may be prevented by means of the sealing member 47 of an O ring, which is provided between the relatively sliding surfaces 43*a* and 43*b*. It is to be noted that the O ring 47 is easy to be damaged owing to not only the high pressure impulses in the fuel or the hydraulically actuating fluid, but also the cavitation occurring in the vicinity thereof.

For the protection of the O ring 47 from the direct effect of the high pressure impulses in the intensified chamber 7, there is provided a split ring 95 made of metal just like the split ring 91 between the relatively sliding surfaces 43*a*, 43*b* at any location between the intensified pressure 7 and the O ring 47. Preferably, the split metal ring 95 is arranged somewhere near the intensified chamber 7 with respect to the O ring 47 between the relatively sliding surfaces 43*a* and 43*b*. According to the embodiment shown, the split metal ring 95 is fitted under the diametral compression in an annular recess 96 around the reduced portion 114 of the boosting piston 120. As an alternative, the annular recess for the split ring may be formed on the reduced concave 42. The intensifying stroke of the boosting piston 120 causes the high-pressure impulses in the fuel in the intensified chamber 7. Such dynamic, high-pressure impulses in the fuel is firstly supported by the split ring 95 fitted in the annular recess 96, so that the O ring 47 is only exposed to a static, substantially constant pressure.

The split ring 95 is substantially equal with the split ring 91 shown in FIG. 1 in its configuration, resilient deflection, absorption property of the high pressure impulses or the like and therefore the repetition of the same description will be omitted. The split ring 95 may predominantly support the high pressure impulses in the fuel occurring in the boosting piston 7 whereby the O ring 47 is protected from damages such as getting rough at its surface due to the impulses and the O ring 47 is only exposed to a static, substantially constant pressure. As an alternative, a decompression groove 97 may be provided around the reduced potion 114 somewhere nearer the intensified chamber 7 with respect to the annular recess 96 in order to decompress the high pressure impulses in the intensified chamber 7.

Figure 3:
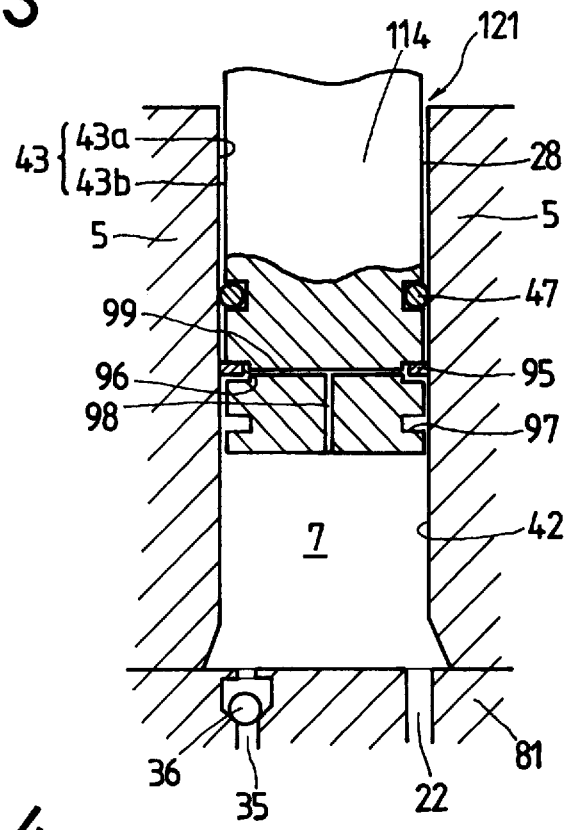
FIG. 3 is a fragmentary axial-sectional view showing the essential parts of a third embodiment of an injector according to the present invention.
Figure 4:
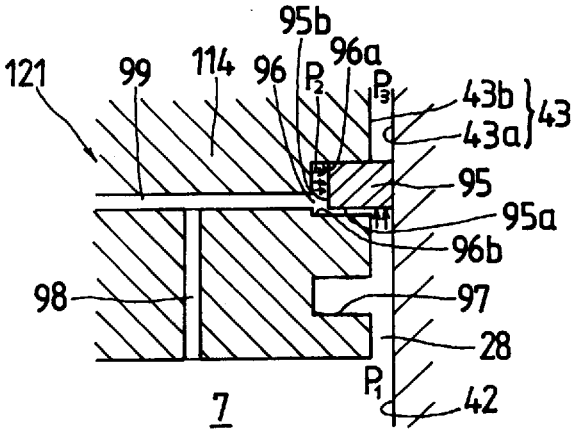
FIG. 4 is a fragmentary enlarged sectioned view of the injector shown in FIG. 3.
Figure 5:
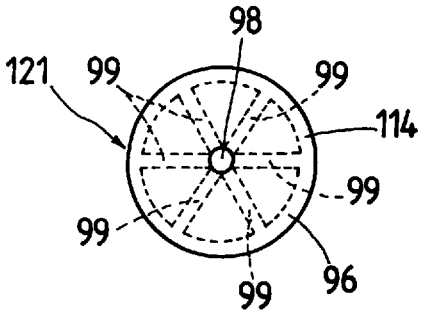
FIG. 5 is a schematic end view showing a radially reduced portion of a boosting piston adapted to the injector shown in FIG. 3.

Next, referring to FIGS. 3 to 5 showing a third embodiment of the present invention, in which FIG. 3 is a fragmentary axial-sectional view showing a boosting piston 121 in a third embodiment of the injector according to the present invention and FIG. 4 is a fragmentary enlarged sectioned view explanatory of communicating passages 98, 99. The third embodiment shown in FIGS. 3 to 5 is substantially equivalent with the boosting piston 120 in FIG. 2, which has the reduced portion 114 provided with the communicating passages 98, 99 for making fluid connections between the intensified chamber 7 and the annular recess 96. In FIGS. 3 to 5, there is shown only the reduced portion 114 of the boosting piston 121 and the enlarged portion is omitted. It is to be noted that the residual constitution other than the communicating passages 98, 99 is identical with that of the embodiment in FIG. 2 and the same reference character identifies equivalent or same parts in both of FIGS. 2 and 3–5. Thus, the repetition of the same description will be omitted in the following description.

The effect of the communicating passages 98, 99 is substantially equivalent with that of the communicating passages 93, 94 shown in FIG. 1. High-pressure impulses $P_1$ occurring in the fuel in the intensified chamber 7, as shown in FIG. 4, act on a lower surface 95*a* of the split ring 95 through the clearance 28. As a result, the split ring 95 is forcibly disengaged from an annular surface 96*b* of the annular recess 96 and urged against an opposite annular surface 96*a* of the annular recess 96. Simultaneously with the above, the high-pressure impulses occurring in the fuel in the intensified chamber 7 causes a pressure $P_2$ acting on a peripheral 95*b* through the communicating passages 98, 99. The split ring 95 fitted under the compression stress is diametrally expanded by the pressure $P_2$ so as to be pressed against the sliding surface 43*a* of the reduced concave 42. Accordingly, the high-pressure impulses occurring in the intensified chamber 7 is supported by the split ring 95 deflected in the form shown in FIG. 4, so that the O ring 47 is subject to no influence of the pressure $P_2$, that is, a pressure $P_4$ exerted to the O ring 4 involve no high-pressure impulses.

Figure 6:
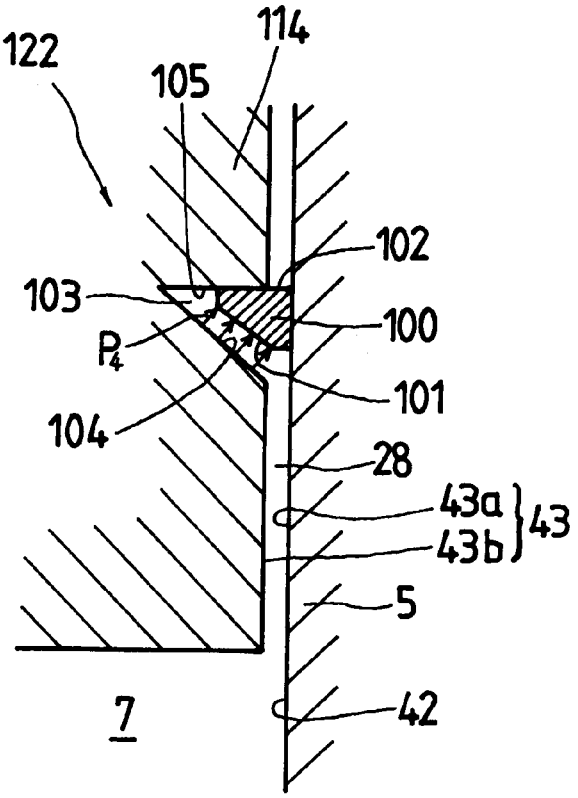
FIG. 6 is a fragmentary axial-sectional view showing the essential parts of a fourth embodiment of an injector according to the present invention.
Figure 7:
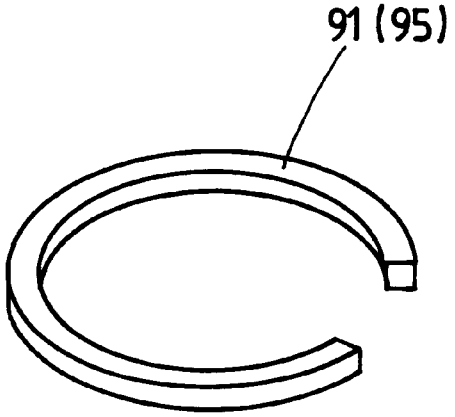
FIG. 7 is a perspective view showing a split metal ring adapted to the injector according to the present invention.

Further referring to FIG. 6, the following explains a fourth embodiment of an injector according to the present invention. The embodiment in FIG. 6 is substantially equivalent to the arrangement in FIG. 2 in that there is provided the split ring between the relatively sliding surfaces 43*a*, 43*b* at any location between the intensified pressure 7 and the sealing member, which is not shown in FIG. 6, but may be of the same as the sealing member 47 in FIG. 2. A split metallic ring 100 is arranged between the relatively sliding surfaces 43*a*, 43*b* of the reduced concave 42 and the reduced portion 114 of a boosting piston 112. The split ring 100 is of a substantially triangular configuration in section and fitted under the diametral compressive stress in an annular recess 103 of triangular cross section such that a tapered surface 101 corresponding with the hypotenuse of the triangle opposes to a tapered surface 104 of the annular recess 103. With high-pressure impulses in the fuel occurring in the intensified chamber 7, the split ring 100 is subjected on its tapered surface 101 to a pressure $P_4$ corresponding to the resultant of a force acting diametrally outwardly of the split ring and a force facing the sealing member 47. The split ring 100 may thus deflect diametrally outwardly against the sliding surface 43*a* of the reduced concave 42 as well as move axially to an annular surface 105 of the annular recess 103, resulting in a position illustrated. It will be understood that the high-pressure impulses in the fuel occurring in the intensified chamber 7 are supported by the split ring 100 and exert no influence to the sealing member 47 of the O ring.

Figure 8:
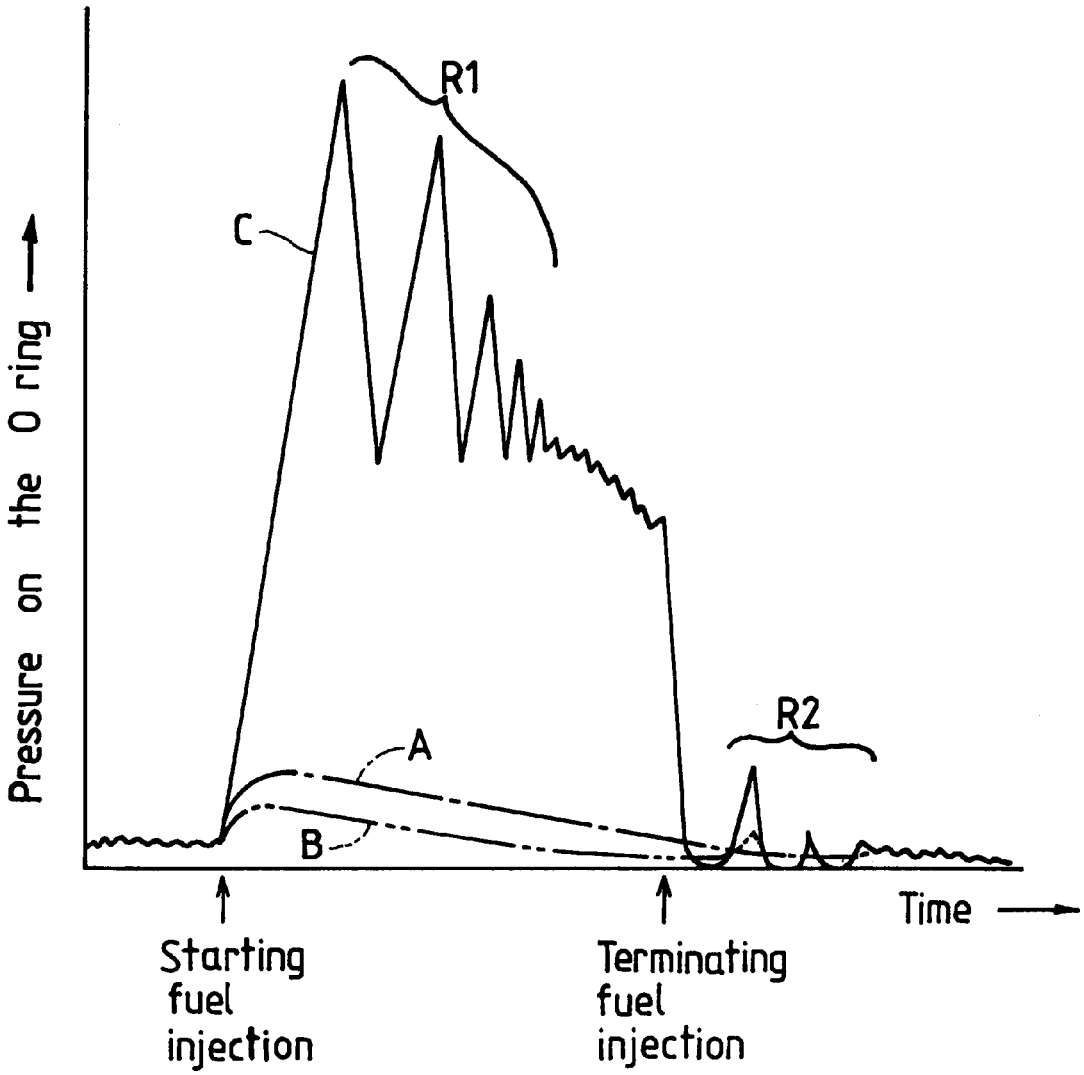
FIG. 8 is a pressure-time chart illustrating variations in a pressure applied to a sealing member of O ring per one injection cycle.

FIG. 8 is a pressure-time chart illustrating variations in a pressure applied to a sealing member of O ring per one injection cycle. In FIG. 8, a curve C illustrates a pressure applied an O ring in the prior injector in which an O ring is alone employed. As will be seen, the O ring is exposed to a high-pressure impulse occurring shortly after starting fuel injection, a reflection waveform R1 repeatedly following the impulse, and another reflection waveform R2 occurring after the termination of injection. The cavitation is apt to occur during the period of the violent pressure variation represented by waveform R1. On the contrary, an one-dotted broken line A shows that the pressure on the O ring decreases remarkably through the whole injection period in the injection of the present invention having the split ring. A two-dotted broken line B shows more reduction in pressure on the O ring, which is realized by adaptation of the split ring and the annular recess 97.

Figure 9:
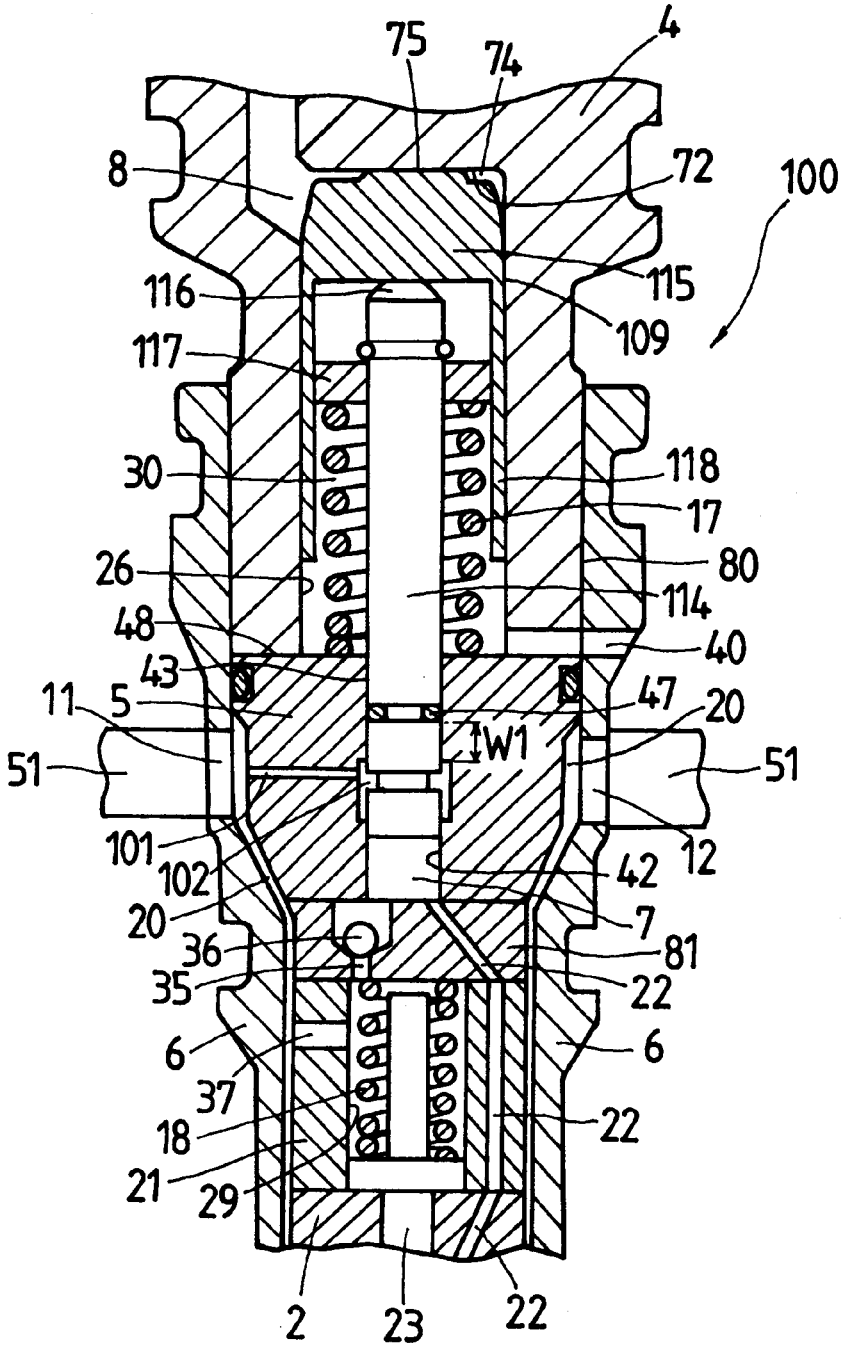
FIG. 9 is a fragmentary axial-sectional view showing the essential parts of a fifth embodiment of an injector according to the present invention.

A fifth embodiment of an injector according to the present invention will be described with reference to FIG. 9, which is a fragmentary enlarged sectional view showing the essential parts of the fifth embodiment. The injector in FIG. 9 is substantially identical with the injector in FIG. 14 with the exception of communicating passages for opening the clearance between the relatively sliding surfaces of the concave and the reduced portion of the boosting piston to a lower-pressure fuel passage. In the following description, the same reference character identifies equivalent or same parts and the repetition of the same parts will be omitted. The injectors in both figures are identical with each other in principal fuel injecting operation and therefore the repetition of the same description will be omitted.

Figure 12:
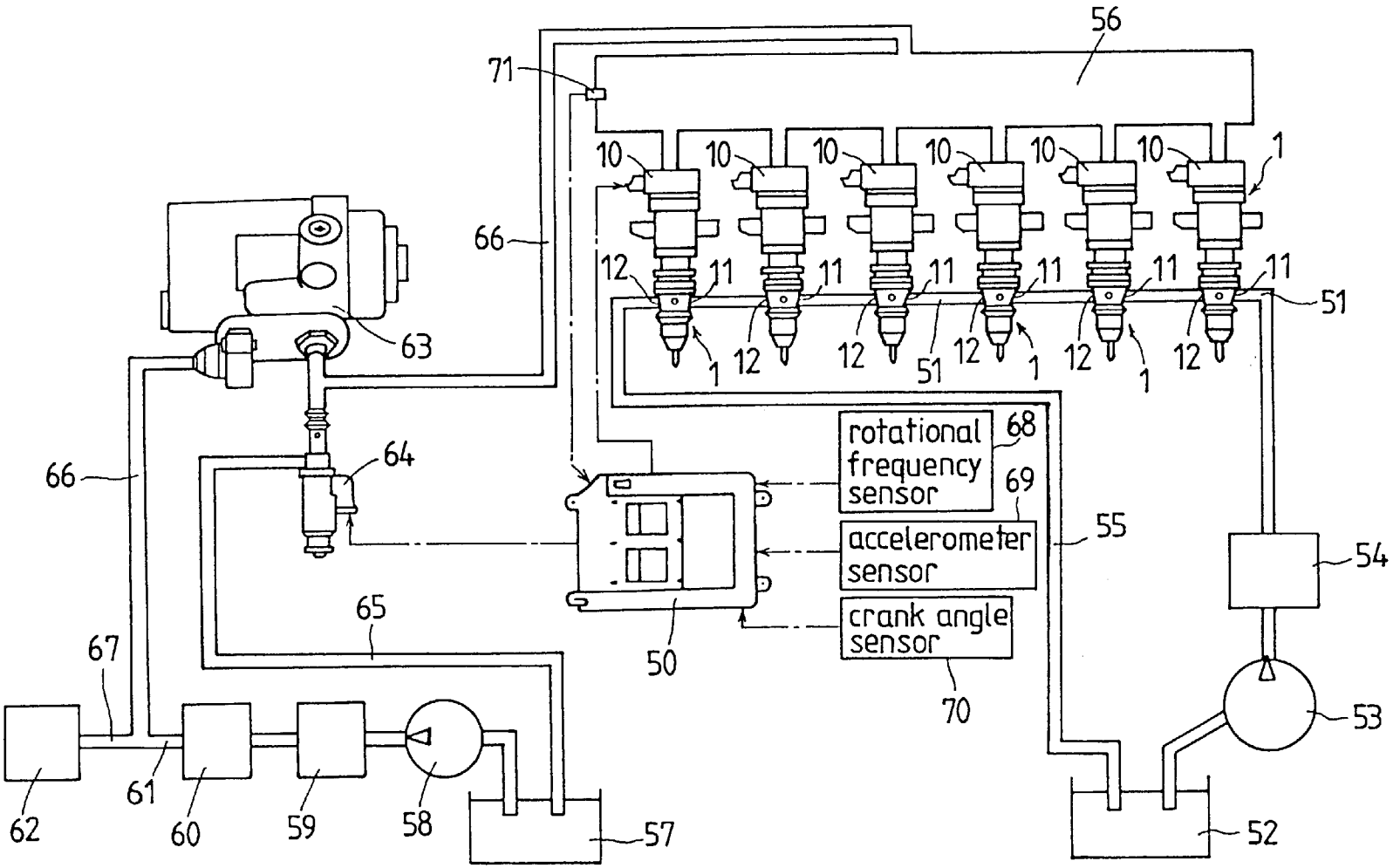
FIG. 12 is a schematic explanatory view showing a fuel supply system for a fuel injection apparatus of engines.

The injector according to the fifth embodiment is to be adapted in combination with the fuel supply system shown in FIG. 12 and assigned per one cylinder. Referring to FIG. 9, there is shown an injector 100, or the fifth embodiment of the present invention. The injector 100 is connected at its fuel inlet 11 and fuel outlet 12 to the common fuel supply rail 51 in the fuel supply system and thus constantly fed with the fuel in the common rail 51. In the following description.

The injector 100 includes the fuel supply body 5 provided with the radially reduced concave 42 which is defined by the spacer body 81 and opened to the radially enlarged concave 26 in the injector body 4. The radially reduced potion 114 of the boosting piston 109 is inserted for reciprocating movement in the reduced concave 42 to thereby provide the intensified chamber 7 defined in the reduced concave 42 by the end of the reduced portion 114 and the opposing surface of the spacer body 81. The sealing member 47 is provided in the clearance between the relatively sliding surfaces 43 of the reduced portion 114 and the reduced concave 42 in order to prevent the fuel from leakage into the radially enlarged concave 26.

The clearance between the relatively sliding surfaces 43 is communicated to the lower-pressure fuel passage such as the common rail 51 or the fuel chamber 20 at any location between the sealing member 47 and the intensified chamber 7. The high-pressure impulses in the fuel may occur in the intensified chamber 7 by intensification of the boosting piston 109, the impulses is nevertheless released to the lower-pressure fuel passage before reaching the sealing member 47 along the relatively sliding surfaces 43. The sealing member 47 may be protected from damages such as getting rough at its surface due to the cavitation or the like and therefore prolonged in sealing property.

The injector 100 is provided with an annular groove 102 on any one of the sliding surfaces of the concave 42 and the reduced portion 114 of the boosting piston 109, the annular groove 102 being fluidly connected with the communicating passage 101. Alternatively, the annular groove 102 may be provided in spanning the sliding surfaces of the concave 42 and the reduced portion 114 of the boosting piston 109. The annular groove 102 is to relax divergently the high-pressure impulses occurring in the intensified chamber 7, resulting in the improvement in durability of the sealing member. For protecting the sealing member 47 from the exposure to the high-pressure impulses occurring in the intensified chamber 7 as well as the damage owing to the shearing at the edge of the annular groove 102, the sealing member 47 is spaced from an adjacent edge, or an upper edge in the drawing, of the annular groove 102 on the concave 42 with an interval W1 which is longer than a stroke the boosting piston 109.

Figure 10:
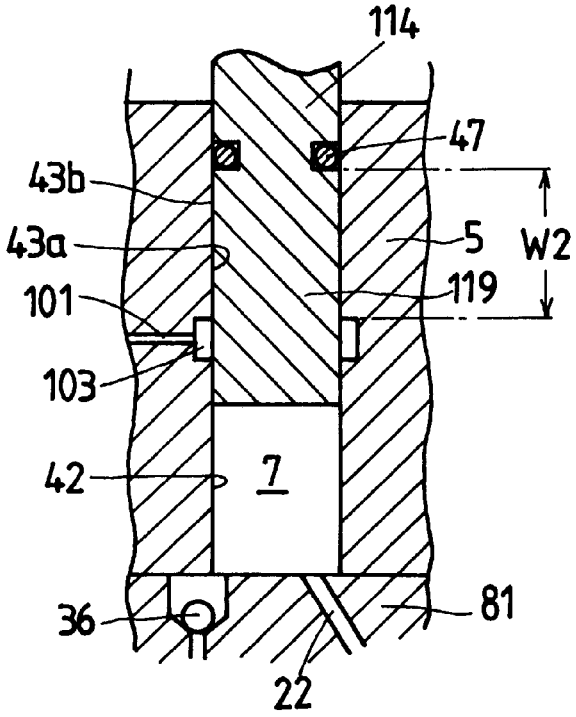
FIG. 10 is a fragmentary axial-sectional view showing the essential parts of a sixth embodiment of an injector according to the present invention.
Figure 11:
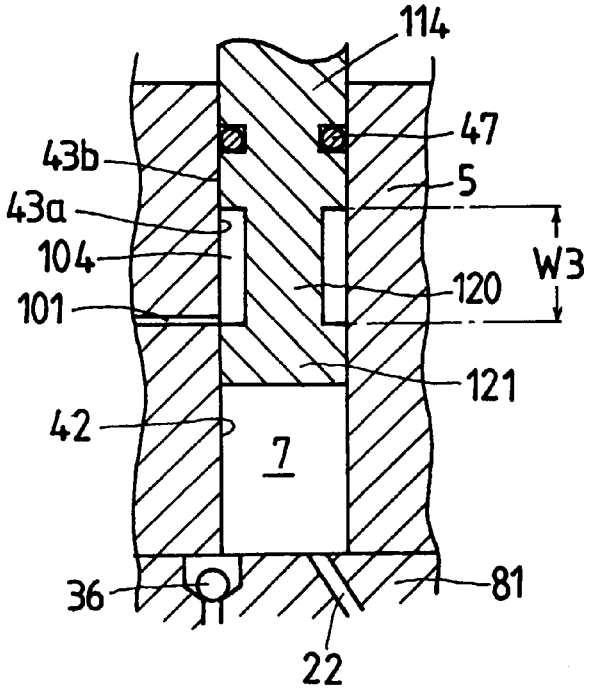
FIG. 11 is a fragmentary axial-sectional view showing the essential parts of a seventh embodiment of an injector according to the present invention.

FIGS. 10 and 11 are fragmentary axial-sectional views, respectively, showing respectively, intensified chambers and related parts of sixth and seventh embodiments of an injector according to the present invention. The residual parts of the injector are substantially identical with that in FIGS. 9 and 14 and therefore the repetition of the same description will be omitted. In the embodiment shown in FIG. 10, an annular groove 103 is provided on only the sliding surface 43*a* of the concave 42 in opposing to the periphery of the lower section 119 of the reduced portion 114 and is connected to the communicating passage 101. For the same reason described above in connection with the interval W1, an interval W2 between the sealing member 47 and the adjacent edge of the annular groove 103 is determined so as to be over a stroke of the boosting piston 109 when the piston 109 is at its top dead center.

Further, in the embodiment shown in FIG. 11, an annular groove 104 is provided on only the sliding surface 43*b* of the reduced portion 114 of the boosting piston 109 so that the reduced portion 114 is made more slender at 120 with leaving a bottom section 121 to thereby provide the annular groove 104. The communication passage 101 may be kept in fluid connection with the annular groove 104 irrespective of any position of the boosting piston 109 in its reciprocating stroke. For the same reason described above in connection with the interval W1, an interval W3 between widthwise-opposing edges of the annular groove 103 is determined so as to be over a stroke of the boosting piston 109.

INDUSTRIAL APPLICABILITY

In accordance with the injector of the present invention as described above, the boosting piston is fitted for reciprocating, sliding movement in the concave in the injector body. The boosting piston is composed of a radially enlarged portion for partially defining the pressure chamber and a radially reduced portion fitted for sliding movement in the concave to thereby partially define the intensified chamber. The sealing member is arranged in the clearance between the relatively sliding surfaces of the concave and any one of the enlarged portion and the reduced portion of the boosting piston. The sealing ring is further arranged between the relatively sliding surfaces at any location between the sealing member and the pressure chamber or between the sealing member and the intensified chamber. The sealing ring is to block the propagation of the high-pressure impulses occurring in the pressure chamber or the intensified chamber along the way of the sliding surfaces, resulting in isolation of the sealing member from the high-pressure impulses. That is, the sealing ring may block the propagation of the high-pressure impulses occurring in the hydraulically actuating fluid in the pressure chamber or in the fuel in the intensified chamber on actuating the control valve. As a result, the sealing member of resin-made O ring is subject to no high-pressure impulses in the hydraulically actuating fluid and cavitation occurrence may be suppressed in the vicinity of the sealing member. Further, the pressure acting on the sealing member may be also reduced in magnitude of the absolute pressure. Consequently, the sealing member may be prolonged in sealing life. The combination of the sealing member with the sealing ring results in ensuring high sealing performance and improved durability of the sealing member of O ring.

Moreover, according to the injector of the present invention, the sealing member is provided in the clearance between the relatively sliding surfaces of the concave and the reduced portion of the boosting piston. The communicating passage connects the clearance between the relatively sliding surfaces with the lower-pressure fuel passage at any location between the sealing member and the intensified chamber. The high-pressure impulses in fuel occurring in the intensified chamber may be released to the lower-pressure fuel passage such as the common fuel supply rail, fuel chamber or the like before reaching the sealing member along the relatively sliding surfaces. The sealing member may be protected from damages such as getting rough at its surface due to the cavitation or the like and therefore prolonged in sealing property. As an alternative, the annular groove is provided on at least any one of the concave and the reduced portion of the boosting piston and connected to the communicating passage. The annular groove may relax the high-pressure impulses from the intensified chamber, resulting in improving the sealing member in durability thereof.

What is claimed is:

1. An injector comprising an intensified chamber formed in an injector body and supplied with a fuel from a common fuel supply rail, a boosting piston for intensifying the fuel in the intensified chamber, the boosting piston being actuated by a hydraulically actuating fluid supplied into a pressure chamber in the injector body, a needle valve arranged in the body so as to open and close nozzle holes to inject the fuel from the intensified chamber, a control valve for controlling the supply of the hydraulically actuating fluid into the pressure chamber to actuate the boosting piston, a return spring for forcing the boosting piston towards its home position, and a casing arranged around the periphery of the injector body to form a fuel chamber and provided with a fuel inlet and a fuel outlet, both of which are communicated with common fluid supply rail, wherein the boosting piston includes a radially enlarged portion forming a part of a surface defining the pressure chamber, and a radially reduced portion forming a part of a surface defining the intensified chamber, both of which portions are fitted for linear sliding movement in a concave in the injector body, a sealing member is provided between relatively sliding surfaces of the radially enlarged portion of the boosting piston and the concave, and a split ring having a diametrical resiliency is provided between the relatively sliding surfaces at any location determined between the sealing member and the pressure chamber.

2. An injector constructed as defined in claim 1, wherein the sealing member is of a resin-made O ring and the split ring includes a split metal ring.

3. An injector constructed as defined in claim 2, wherein the split metal ring is fitted in an annular recess on the enlarged portion of the boosting piston with a diametrally compressed stress.

4. An injector constructed as defined in claim 3, wherein a communicating passage is provided in the enlarged portion of the boosting piston for making a fluid connection between the pressure chamber and the annular recess.

5. An injector comprising an intensified chamber formed in an injector body and supplied with a fuel from a common fuel supply rail, a boosting piston for intensifying the fuel in the intensified chamber, the boosting piston being actuated by a hydraulically actuating fluid supplied into a pressure chamber in the injector body, a needle valve arranged in the body so as to open and close nozzle holes to inject the fuel from the intensified chamber, a control valve for controlling the supply of the hydraulically actuating fluid into the pressure chamber to actuate the boosting piston, a return spring for forcing the boosting piston towards its home position, and a casing arranged around the periphery of the injector body to form a fuel chamber and provided with a fuel inlet and a fuel outlet, both of which are communicated with common fluid supply rail, wherein the boosting piston includes a radially enlarged portion fitted for linear sliding movement in a radially enlarged concave in the injector body and forming a part of a surface defining the pressure chamber, and a radially reduced portion fitted for linear sliding movement in a radially reduced concave in the injector body and forming a part of a surface defining the intensified chamber, a sealing member is provided between relatively sliding surfaces of the radially reduced portion of the boosting piston and the concave, and a split ring having a diametrical resiliency is provided between the relatively sliding surfaces at any location determined between the sealing members and the intensified chamber.

6. An injector constructed as defined in claim 5, wherein the sealing member is of a resin-made O ring and the split ring is a split metal ring.

7. An injector constructed as defined in claim 6, wherein the split metal ring is fitted in an annular recess on the reduced portion of the boosting piston with a diametrally compressed stress.

8. An injector constructed as defined in claim 7, wherein a communicating passage is provided in the reduced portion of the boosting piston for making a fluid connection between the intensified chamber and the annular recess.

9. An injector comprising an intensified chamber formed in an injector body and supplied with a fuel from a common fuel supply rail, a boosting piston for intensifying the fuel in the intensified chamber, the boosting piston being actuated by a hydraulically actuating fluid supplied into a pressure chamber in the injector body, a needle valve arranged in the body so as to open and close nozzle holes to inject the fuel from the intensified chamber, a control valve for controlling the supply of the hydraulically actuating fluid into the pressure chamber to actuate the boosting piston, a return spring for forcing the boosting piston towards its home position, and a casing arranged around the periphery of the injector body to form a fuel chamber and provided with a fuel inlet and a fuel outlet, both of which are communicated with common fluid supply rail, wherein the boosting piston includes a radially enlarged portion fitted for linear sliding movement in a concave in the injector body and forming a part of a surface defining the pressure chamber, and a radially reduced portion fitted for linear sliding movement in a concave in the injector body and forming a part of a surface defining the intensified chamber, a sealing member is provided between relatively sliding surfaces of the radially reduced portion of the boosting piston and the concave, and a communicating passage connects the relatively sliding surfaces with any one of the common fuel supply rail and the fuel chamber at any location determined between the sealing members and the intensified chamber.

10. An injector constructed as defined in claim 9, wherein an annular groove is provided on any one of the relatively sliding surfaces of the concave and the reduced portion of the boosting piston and is connected to the communicating passage.

* * * * *